United States Patent [19]

Maddock

[11] Patent Number: 4,778,409

[45] Date of Patent: Oct. 18, 1988

[54] SCREW IN LAMP HOLDER

[75] Inventor: William H. Maddock, Markham, Canada

[73] Assignee: Noma Inc., Scarborough, Canada

[21] Appl. No.: 946,561

[22] Filed: Dec. 24, 1986

[51] Int. Cl.[4] ..... H01R 13/40

[52] U.S. Cl. ..... 439/602; 439/605; 439/735; 439/736

[58] Field of Search ..... 439/736, 665, 666, 667, 439/735, 340, 351, 360, 361, 362, 366, 661, 662, 664, 659, 168, 182, 220, 280, 336, 356, 375, 414, 419, 541, 558, 602, 605, 615; 29/848, 849, 856

[56] References Cited

U.S. PATENT DOCUMENTS

| | | | |
|---|---|---|---|
| 2,172,347 | 9/1939 | Clemence | 439/667 |
| 2,620,376 | 12/1952 | Benander | 173/358 |
| 2,869,097 | 1/1959 | Stuart | 339/69 |
| 2,869,101 | 1/1959 | Benander | 339/99 |
| 2,975,392 | 3/1961 | Ludwig | 339/99 |
| 3,128,141 | 4/1964 | Krupp et al. | 339/97 |
| 3,251,023 | 5/1966 | Schick | 339/99 |
| 3,404,453 | 10/1968 | Moranduzzo | 29/628 |
| 3,597,725 | 8/1971 | Beck | 339/97 |
| 3,716,818 | 2/1973 | Finkelstein | 339/119 |

FOREIGN PATENT DOCUMENTS

| | | |
|---|---|---|
| 1033291 | 1/1963 | United Kingdom . |
| 1085091 | 3/1964 | United Kingdom . |
| 1134404 | 6/1964 | United Kingdom . |
| 1126925 | 9/1965 | United Kingdom . |

*Primary Examiner*—David Pirlot

*Attorney, Agent, or Firm*—Kenneth M. Garrett

[57] ABSTRACT

A molded electrical lamp socket includes threaded, insulating portions on the inner wall of the socket to engage the lamp. The side electrode providing electrical contact for the lamp is desirably set deeply within the socket, to reduce the danger of accidental finger contact with an electrically conducting lamp. Where the side electrode is of the edge-on type, the insulating threads center the lamp in the socket and reduce the incidence of shaving and jamming of the lamp.

10 Claims, 1 Drawing Sheet

SCREW IN LAMP HOLDER

FIELD OF INVENTION

This invention relates to a molded electrical lamp socket adapted to receive a screw in type light bulb.

BACKGROUND OF INVENTION

It is known from the prior art to provide electrical lamp sockets molded from an electrically insulating material, wherein the side electrode and the bottom electrode by which a light bulb is energized are inserted within the mold and firmly anchored within the molded socket during the molding process. The side electrode may be of a type which includes inwardly extending edge-on protrusions profiled to engage the threads of the screwing portion, i.e. the screw cap, of the light bulb.

The side electrode functions both to provide an electrical contact, and also to mechanically locate and retain the light bulb within the socket. Accordingly, the side electrode is profiled to engage the screw cap of the light bulb over an appreciable axial length thereof. Generally speaking, in light bulbs of this nature, there are some three complete turns of thread around the screw cap, and the side electrode is formed by first and second diametrically opposed portions each provided with three protrusions which engage the troughs between the threads.

Increasingly, the screw caps of light bulbs are being formed from aluminum, whereas the edge-on side electrodes are formed from brass. It is often found that shaving of the screw cap takes place as the light bulb is being screwed into or out of the electrical lamp socket. Where the electrical lamp sockets are used out-doors, some oxidation of the screw caps may occur. Both shaving and corrosion promote the jamming of the light-bulb in the socket. When excessive force is applied to the glass envelope of the light bulb in an endeavour to unjam it, breakage may ensue. It is also possible for the shavings to bridge between the electrodes, thereby creating a potential hazard.

In the prior art lamp sockets, whether of conventional design or of the edge-on type, when a lamp is being inserted into a socket, electrical contact is made between the screw cap and the side electrode while an appreciable portion of the screw cap is located outside of the confines of the electrical lamp socket, thereby creating a further potential hazard.

SUMMARY OF THE INVENTION

The present invention provides, in a molded electrical lamp socket having a hollow cylindrical insulating body portion within which to insert the screw cap portion of a light bulb, and a side electrode located within the hollow body portion to engage threaded portions of the screw cap in electrically contacting and axially securing relation therewith, the improvement comprising at least one insulating protrusion projecting inwardly of the cylindrical wall portion of the socket, located to center the screw cap within the socket and to engage the screw cap in complementary mechanical securing relation with the side electrode.

In one embodiment, the side electrode comprises a pair of inwardly protruding portions arranged in angularly spaced relation and there is located therebetween a plurality of the foregoing insulating protrusions supported from the interior wall of the electrical lamp socket.

In accordance with a preferred embodiment, a plurality of the insulating protrusions are provided, which protrusions are integrally formed with the wall of the electrical socket, and are arranged in handed, angularly inclined relation with the polar axis of the socket, at an angle corresponding to the pitch angle of threaded portions of the light bulb screw cap, so as to threadably engage the screw cap on rotational insertion of the screw cap therein.

Since the subject insulating protrusions act to retain and center the screw cap mechanically in the socket, the side electrode can be substantially relieved of these functions. Accordingly, in the preferred embodiment, the side electrode contacts the screw cap over a limited axial length thereof, so that shaving and jamming are substantially eliminated. Moreover, the side electrode may locate in the socket substantially towards the blind end thereof, whereby no electrical contact will be made between the screw cap of a lamp and the side electrode until such time as the screw cap is substantially surrounded by the insulating socket, whereby accidental finger contact with an electrically live screw cap is avoided.

In accordance with yet another aspect of the invention, the complementary insulating protrusions on the socket wall are each specially profiled in order to co-react in a preferred manner with the threads of the screw cap, and to facilitate the molding of the socket, while not detracting from their holding and centering action.

These objects, aims and advantages of the invention, and other objects, aims and advantages will become more apparent from a consideration of preferred embodiments thereof, taken in conjunction with the accompanying drawing,

DESCRIPTION OF THE PREFERRED EMBODIMENT

Figure 1:
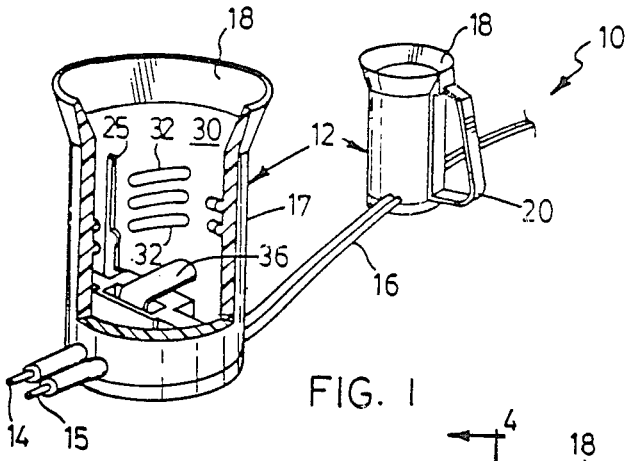
FIG. 1—is a general view showing a plurality of the subject molded lamp sockets in molded relation with a pair of elongated electrical conductors, one of the lamp sockets being in partial section.

Referring to FIG. 1, a light string assembly 10 is shown to include two of the subject lamp sockets 12 secured in molded relation to a pair of elongated electrical conductors 14,15 having an insulating cover 16 thereon. In practise, the number of lamp sockets forming a light string may commonly be for example ten or considerably more. The lamp socket 12 may be electrically interconnected with conductors 14,15 in serial or in parallel relationship, as is commonly known in the art.

Referring to the other figures of drawings, lamp socket 12 includes a cup like insulating body 17, an outwardly flared rim 18 unitarily formed with body 17 and a flexible curved hook 20 which is also conveniently unitarily molded with body 17, and which serves to facilitate the attachment of light string assembly 10 to suitable mountings.

Figure 5:
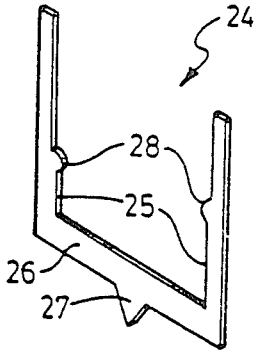

The cylindrical body 17 of lamp socket 12 contains a side electrode 24 therein, the structure of which is best seen with reference to FIG. 5. Side electrode 24 is planar and may be conveniently struck from sheet brass or the like, and comprises a pair of diametrically opposed, upstanding arms 25 interconnected at their lower ends by a cross member 26. A stab connector 27 extends downwardly from cross member 26. The inwardly facing edges of arms 25 are generally parallel and vertically aligned, and are each provided intermediate their ends with a single protuberance 28 located as will be described subsequently.

The interior wall 30 of body 17 is provided with a helical thread 32 which projects inwardly from the wall at a pitch angle "a", which is that of the thread of the screw cap C of an electrical lamp L to be retained in the socket. Each 360° turn of thread 32 comprises four segments 34 symmetrically located on interior wall 30. The significance of this arrangement is discussed subsequently.

Figure 2:
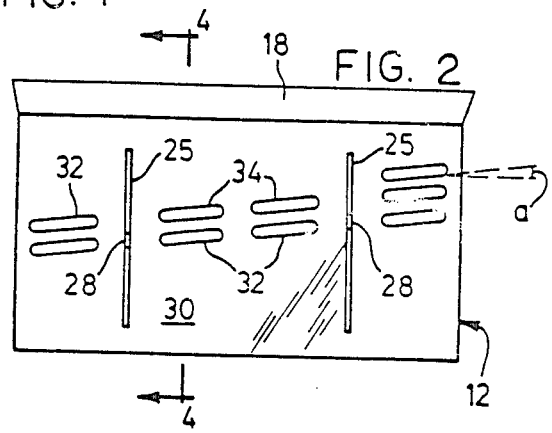
FIG. 2—is a developed view of the interior cylindrical surface of the lamp socket.

A central electrode 36 locates in the bottom of socket 12. For further details of the general construction of socket 12 including the integration of electrodes 24 or 36 therein and its molding onto electrical conductors 14, reference may be had to U.S. Pat. Nos. 3,597,725 and 3,900,278 to Beck et al, commonly assigned herewith, which patents are incorporated herein by reference thereto. When molded, the inwardly facing edge of each arm 25 of side electrode 24 will be generally flush with the interior wall of body 17, and the protuberance 28 will project inwardly therefrom. As will be apparent from FIGS. 1 and 2, the protuberances 28 locate on the helical path of thread 32, in alignment with the lowest row of segments 34.

It will be appreciated that for maximum holding power of a lamp in lamp socket 12, the thread 32 would be continuously formed around the surface of interior wall 30 of the lamp socket; additionally the thread would be wholly complementary in profile to the thread of a lamp base to be retained in the lamp socket.

Figure 4:
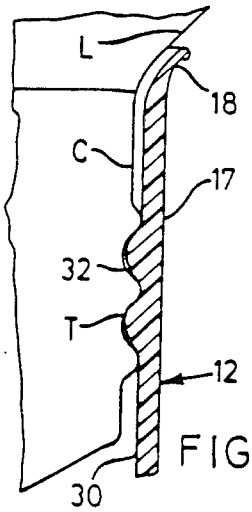
FIG. 4—is a cross section along 4—4 of FIG. 2, with a lamp bulb engaged in the socket, and FIG. 5—is a general view of the side electrode construction of the subject lamp socket.
Figure 3:
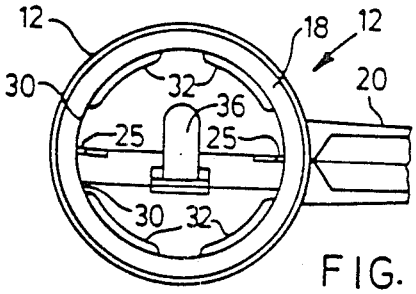
FIG. 3—is a plan view of the subject lamp socket.

Generally speaking, and as seen from FIG. 4, the lamp base thread T in axial cross section approaches a sinusoidal curve. In molding lamp socket 12, the interior wall 30 thereof, including thread 32, will be defined by a mold insert. While collapsible mold inserts are known, which would permit the formation of a continuous and fully sinusoidal thread profile around the interior wall 30 of the lamp socket, this would be economically disadvantageous, due to the relatively long cycle time associated with the use of the collapsible mold inserts.

In accordance with this illustrative embodiment, the thread 32 on the interior wall of the lamp socket 12 is made to be substantially discontinuous along the helical path thereof, with one turn comprising four segments 34 each consisting of about one tenth of a turn; otherwise expressed, each segment extends over a horizontal arc of about 40°. This angle is not critical, and its precise value and number of the segments will depend in part upon the profile of the segments each of these factors being balanced so as to permit the easy withdrawal of the mold inserts from the molded lamp socket 12, without necessitating the use of collapsible mold inserts earlier spoken of, while not substantially reducing the holding power of the threads.

The segments 34 of thread 32 have a asymmetric wave like profile; the wave front rises from a trough in a generally sinusoidal manner, following the profile of threads T, and crests at about 40% of the distance between adjacent troughs, measured from the upper trough, as seen in FIG. 4. The amplitude of the crests of thread 32 is therefore somewhat less than the amplitude of threads T.

The asymmetric wave like profile of insulating threads 32 is formed in part by the design of the mold insert (not shown) and in part it will result from the withdrawal of the mold insert from socket 12 when the material thereof is in a semi-plastic state, thereby tending to draw insulating material upwardly from the back of the wave towards the wave front, and displace the wave crest upwardly.

When a lamp L is inserted into socket 12, the insulating threads 32 thereof will threadably engage the threads T of the lamp adjacent the major diameter only thereof, but this limited degree of engagement has been found to be adequate to permit the good retention of the lamp with the socket, at least when the lamp is fully screwed into position therein. The threads T of lamp L in particular, and the screw cap C in general, will not make electrical contact with side electrode 24 until the lamp is substantially screwed into position, by which time cap C will be substantially surrounded by the cylindrical body 17 and flared rim 18, both of which are insulating, thereby precluding accidental finger contact with an electrically live cap.

The invention has been described in relation to a preferred embodiment from which numerous changes may be made and may appear to be desirable according to particular circumstances, while meeting the broad aims and objects of the invention. All such changes are intended to fall within the ambit of claims appended hereto.

I claim:

1. In an electric lamp socket including at least one planar side electrode aligned with the axis of said socket, profiled so as to engage a screw cap of a lamp in threaded relationship, said socket being formed in one piece about a wire conductor in a molding process using a mold insert to define the interior wall surface of said socket and locate said side electrode during said molding process, the improvement wherein said interior wall surface is provided with a plurality of insulating ribs integral therewith each of limited helical extent located in complementary screw cap engaging relationship with said side electrode, said ribs being shaped so as to permit withdrawal of said mold insert from said socket by axial movement only when said socket is in a semi plastic condition without necessitating the collapse of said mold insert.

2. The lamp socket as set forth in claim 1, wherein said side electrode comprises a pair of diametrically opposed arms, said insulating ribs being angularly spaced from each of said arms.

3. The lamp socket as set forth in claim 2, wherein adjacent ones of said insulating ribs are in angularly inclined relation from the polar axis of said socket at an angle substantially equal to the pitch angle of thread portions of said screw cap.

4. The lamp socket as set forth in claim 3, wherein each said insulating rib subtends an arc of about 40° about the polar axis of said socket.

5. The lamp socket as set forth in claim 4, wherein there are two rows of said insulating ribs, with each row subtending an arc of 360° about the polar axis of said socket.

6. The lamp socket as set forth in claim 5, wherein each said row comprises four said insulating ribs.

7. The lamp socket as set forth in claim 5, wherein each said arm is profiled with only one screw cap engaging protuberance thereon, and wherein said protuberance locate within said socket on the path of the lower of said rows.

8. The lamp socket as set forth in claim 7, wherein each said insulating rib includes a crest portion, an upper trough portion and a lower trough portion, and wherein said crest portion locates closer to an associated upper trough portion than to an associated lower trough portion.

9. The lamp socket as set forth in claim 7, including an insulating outwardly flared shroud unitarily formed with said cylindrical body portion.

10. A socket as set forth in claim 9, in combination with a plurality of like sockets in molded, contacting relation with a pair of elongated electrical conductors.

* * * * *